US008876258B2

(12) United States Patent
Takada

(10) Patent No.: US 8,876,258 B2
(45) Date of Patent: Nov. 4, 2014

(54) LIQUID EJECTING HEAD AND LIQUID EJECTING APPARATUS

(75) Inventor: Akira Takada, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 87 days.

(21) Appl. No.: 13/252,261

(22) Filed: Oct. 4, 2011

(65) Prior Publication Data

US 2012/0086759 A1 Apr. 12, 2012

(30) Foreign Application Priority Data

Oct. 8, 2010 (JP) ..... 2010-229075

(51) Int. Cl.
*B41J 2/015* (2006.01)
*B41J 2/14* (2006.01)

(52) U.S. Cl.
CPC .... *B41J 2/14233* (2013.01); *B41J 2002/14491* (2013.01)
USPC ..... 347/68

(58) Field of Classification Search
None
See application file for complete search history.

(56) References Cited

U.S. PATENT DOCUMENTS

2009/0213189 A1 8/2009 Okubo

FOREIGN PATENT DOCUMENTS

| | | | |
|---|---|---|---|
| JP | 10-202876 | | 8/1998 |
| JP | 2006-281477 | | 10/2006 |
| JP | 2006281477 A | * | 10/2006 |
| JP | 2009-226923 | | 10/2009 |

* cited by examiner

*Primary Examiner* — Matthew Luu
*Assistant Examiner* — Erica Lin
(74) *Attorney, Agent, or Firm* — Workman Nydegger

(57) ABSTRACT

A liquid ejecting head includes: a pressure generation chamber that communicates with a nozzle opening which ejects liquid; a pressure generation unit that causes a change in pressure in the pressure generation chamber; and a flexible wiring substrate that transmits a control signal from outside and includes a wiring layer which is connected to each individual electrode of a plurality of pressure generation units and also connected to a terminal portion of a common electrode common to the plurality of pressure generation units. In the liquid ejecting head, the wiring layer of the wiring substrate includes slits in an area connected to the terminal portion of the common electrode of the pressure generation unit, while the wiring layer of the wiring substrate and the terminal portion of the pressure generation unit are connected via an anisotropic conductive material.

6 Claims, 5 Drawing Sheets

LIQUID EJECTING HEAD AND LIQUID EJECTING APPARATUS

This application claims a priority to Japanese Patent Application No. 2010-229075 filed on Oct. 8, 2010 which is hereby expressly incorporated by reference herein in its entirety.

BACKGROUND

1. Technical Field

The present invention relates to liquid ejecting heads and liquid ejecting apparatuses that eject liquid through nozzle openings and, in particular, to ink jet recording heads and ink jet recording apparatuses that discharge ink as liquid.

2. Related Art

An ink jet recording head making use of flexural deformation of a piezoelectric actuator that is configured of a lower electrode, a piezoelectric layer and an upper electrode, has been put to practical use. In such ink jet recording head, part of a pressure generation chamber communicating with a nozzle opening is configured by a vibration plate, the vibration plate is deformed by the piezoelectric actuator as a piezoelectric element to pressurize ink in the pressure generation chamber, and consequently an ink droplet is discharged through the nozzle opening.

Further, a drive circuit is mounted on a wiring substrate, such as a printed substrate or the like, that supplies a drive signal to drive the piezoelectric actuator; the drive signal from the drive circuit is supplied to the piezoelectric actuator via the wiring (for example, see JP-A-2006-281477).

With increase in the number and density of nozzle rows, ink jet recording heads equipped with a plurality of piezoelectric actuators are required. However, if a conductive connection area of a connection portion that connects a common electrode common to a plurality of piezoelectric actuators with a wiring of a wiring substrate is small, electric resistance thereof is increased so as to cause a voltage drop and the like when the plurality of piezoelectric actuators are driven at the same time. As a result, a sufficiently high voltage cannot be applied due to the voltage drop such that there arises a problem of causing a driving failure.

In addition, if the electric resistance of the connection portion that connects the common electrode of the piezoelectric electrodes with the wiring of the wiring substrate becomes larger, heat is generated in the connection portion. This causes another problem to arise, i.e., a breakdown such as peeling-off of the wiring substrate is likely to happen.

Furthermore, if the area of a terminal portion is enlarged so as to enlarge the area of a connection portion that conducts electricity between the common electrode of the piezoelectric actuators and a wiring of an external wiring circuit, a problem arises such that an ink jet recording head becomes larger.

SUMMARY

An advantage of some aspects of the invention is to provide a liquid ejecting head and a liquid ejecting apparatus in which electric resistance of a connection portion that conducts electricity between a wiring substrate and a common electrode is decreased so that a driving failure of a piezoelectric actuator can be suppressed, increase in the number of rows of nozzle openings and in the density of nozzle openings can be realized, and miniaturization of the liquid ejecting head and liquid ejecting apparatus can be also realized.

In order to solve the problems mentioned above, a liquid ejecting head according to an aspect of the invention includes: a pressure generation chamber that communicates with a nozzle opening which ejects liquid; a pressure generation unit that causes a change in pressure in the pressure generation chamber; and a flexible wiring substrate that transmits a control signal from outside and includes a wiring layer which is connected to each individual electrode of the plurality of pressure generation units and also connected to a terminal portion of a common electrode common to the plurality of pressure generation units. In the liquid ejecting head, it is preferable that the wiring layer of the wiring substrate include slits in an area connected to the terminal portion of the common electrode of the pressure generation unit, and the wiring layer of the wiring substrate and the terminal portion of the pressure generation unit be connected via an anisotropic conductive material.

According to this aspect, by providing slits in an area of the wiring layer connected to the terminal portion of the common electrode, the wiring layer is disposed along an uneven surface of the terminal portion of the common electrode, a gap between the wiring layer and the terminal portion is substantially uniformized, the number of conductive particles contained in the anisotropic conductive material that connects the wiring layer to the terminal portion is made to increase, and consequently electric resistance of the connection portion can be reduced.

It is preferable that the pressure generation unit be provided on a flow path forming substrate in which the pressure generation chamber is formed, and be configured of a piezoelectric actuator including an upper electrode, a piezoelectric layer and a lower electrode. With this configuration, a liquid droplet can be discharged through the nozzle opening by driving the piezoelectric actuator, and a drop in an electric current can be suppressed even if a plurality of piezoelectric actuators are driven simultaneously.

It is preferable that the terminal portion of the common electrode be provided with the periphery thereof protruding with respect to the central portion thereof. Even if the periphery of the terminal portion protrudes with respect to the central portion, electric resistance can be reduced by increasing the number of conductive particles that connect the wiring layer to the terminal portion.

A liquid ejecting apparatus according to another aspect of the invention includes the liquid ejecting head according to the aforementioned aspects.

According to this aspect, a liquid ejecting apparatus that suppresses a driving failure, breakdown and the like can be realized.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, details of the invention will be described based on embodiments.

First Embodiment

Figure 1:
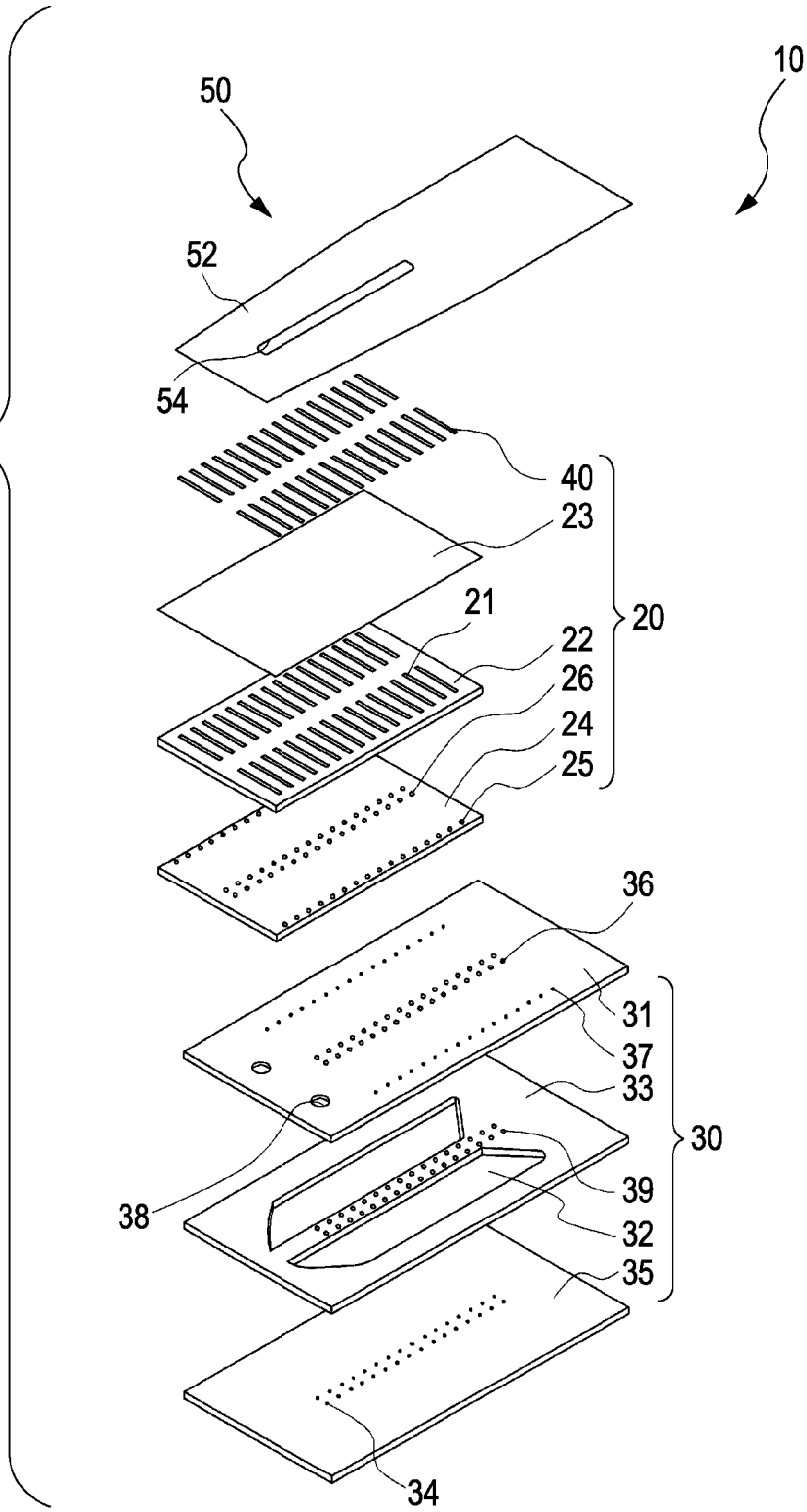
FIG. 1 is an exploded perspective view illustrating a recording head according to a first embodiment of the invention.
Figure 2A:
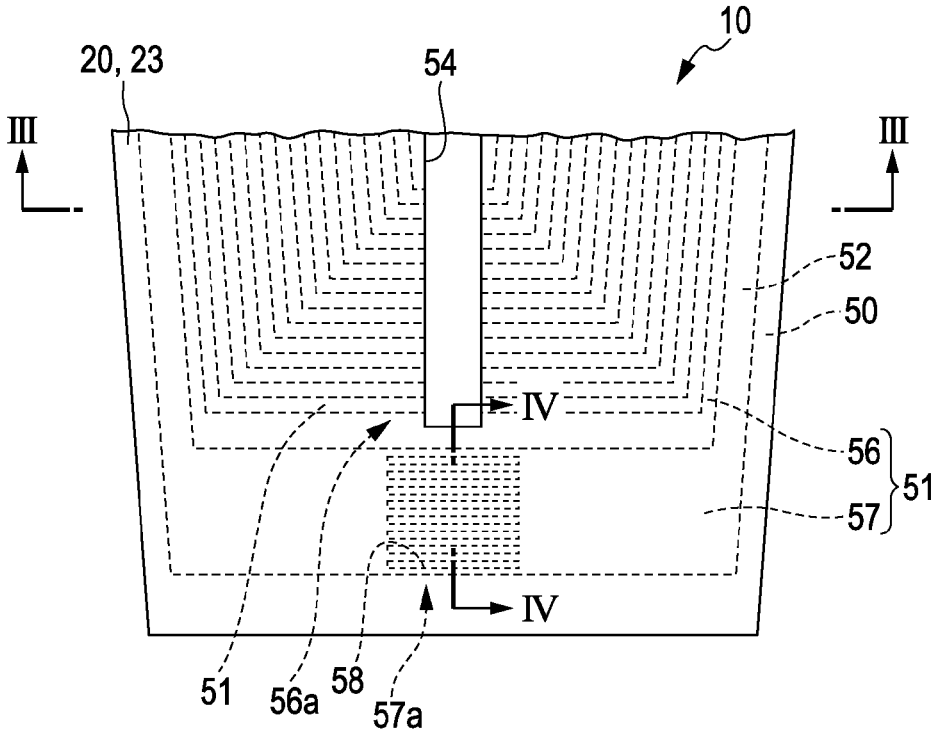
FIG. 2A is a plan view illustrating a recording head according to the first embodiment.
Figure 2B:
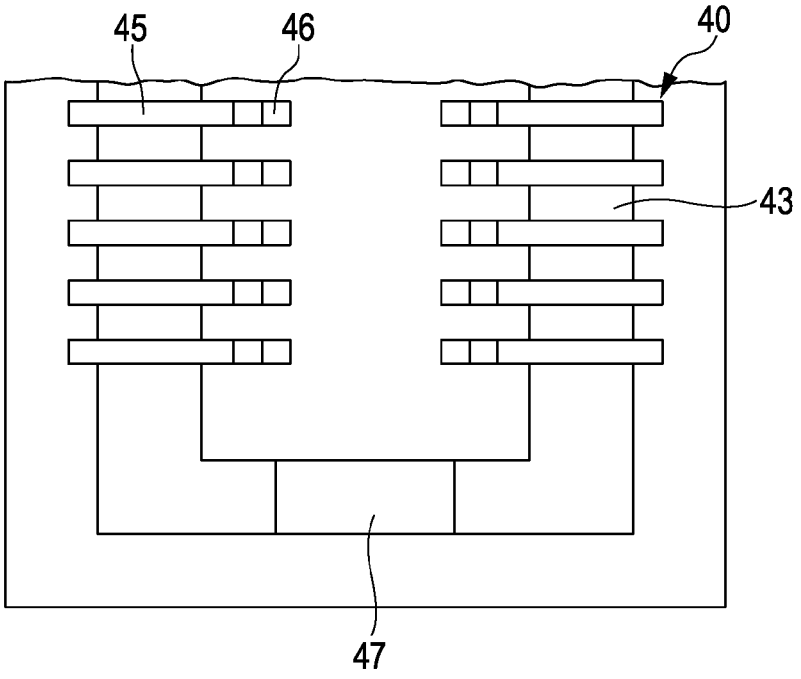
FIG. 2B is a plan view illustrating an actuator unit according to the first embodiment.
Figure 3:
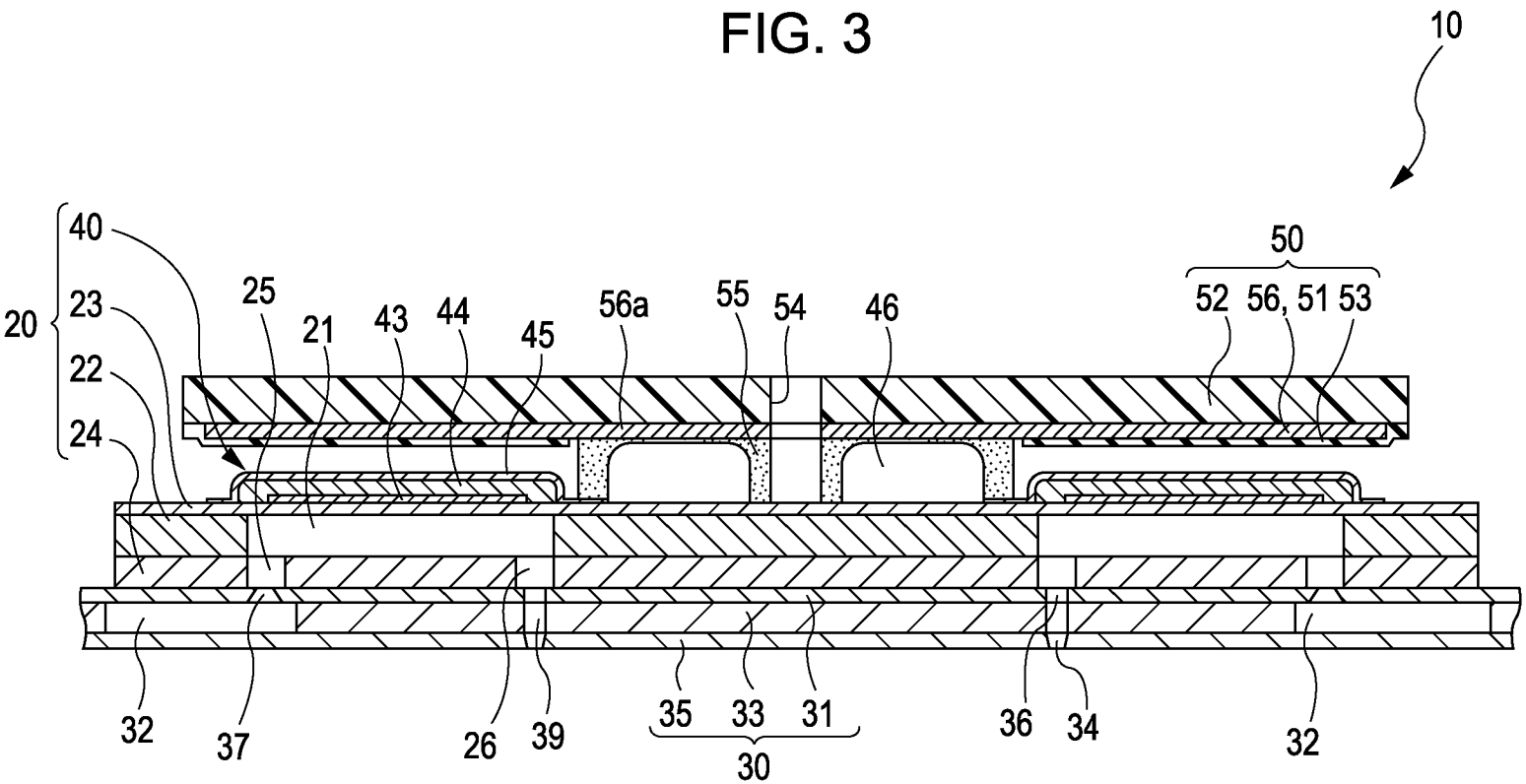
FIG. 3 is a cross-sectional view illustrating a recording head according to the first embodiment.
Figure 4:
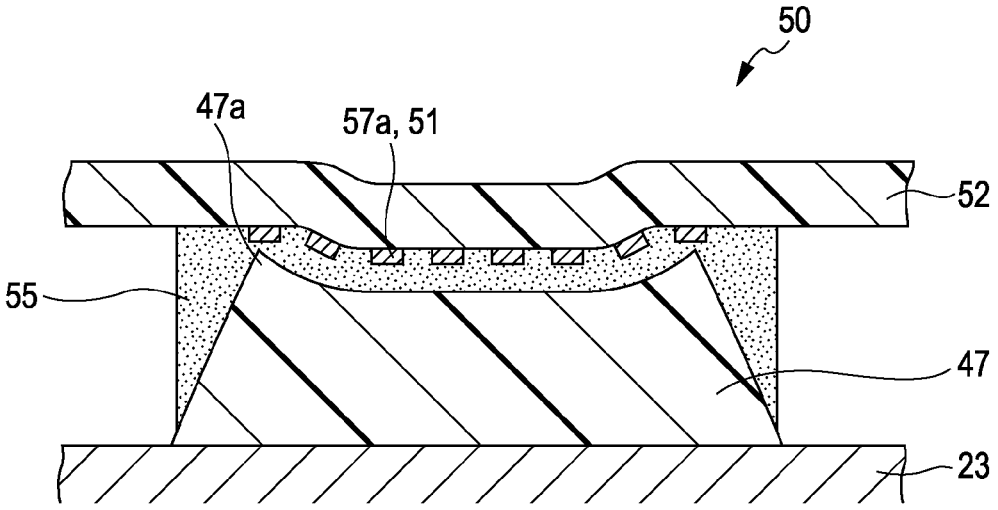
FIG. 4 is another cross-sectional view illustrating a recording head according to the first embodiment.

FIG. 1 is an exploded perspective view of an ink jet recording head as an example of a liquid ejecting head according to a first embodiment of the invention. FIG. 2A is a plan view of the ink jet recording head, while FIG. 2B is a plan view of an actuator unit. FIG. 3 is a cross-sectional view taken along the line III-III in FIG. 2, while FIG. 4 is a main portion cross-sectional view taken along the line IV-IV in FIG. 2.

As shown in the drawings, an ink jet recording head 10 is configured of an actuator unit 20, a flow path unit 30 to which the actuator unit 20 is fixed, and a wiring substrate 50 that is connected to the actuator unit 20.

The actuator unit 20 is an actuator device that is equipped with a piezoelectric actuator 40 as a pressure generation unit and includes a flow path forming substrate 22 in which a pressure generation chamber 21 is formed, a vibration plate 23 disposed on one face side of the flow path forming substrate 22, and a pressure generation chamber bottom plate 24 disposed on the other face side of the flow path forming substrate 22.

The flow path forming substrate 22 is made of a ceramics plate such as alumina ($Al_2O_3$), zirconia ($ZrO_2$) or the like with a thickness of approximately 150 μm, for example. In the embodiment, a plurality of pressure generation chambers 21 are arranged in two rows. In each row, the pressure generation chambers 21 are arranged in parallel to each other along the width direction of the pressure generation chamber 21. The vibration plate 23 made of a thin zirconia plate with a thickness of 10 μm, for example, is fixed to the one face of the flow path forming plate 22, and one face of the pressure generation chamber 21 is sealed with this vibration plate 23.

The pressure generation chamber bottom plate 24 is fixed to the other face side of the flow path forming substrate 22 to seal the other face of the pressure generation chamber 21, and includes a supply communication hole 25 that is provided in the vicinity of one end portion in the lengthwise direction of the pressure generation chamber 21 to communicate the pressure generation chamber 21 to a manifold 32 which is explained later, and a nozzle communication hole 26 that is provided in the vicinity of the other end portion in the lengthwise direction of the pressure generation chamber 21 to communicate to a nozzle opening 34 which is explained later.

Each of the piezoelectric actuators 40 is provided in an area facing to each of the pressure generation chambers 21 on the vibration plate 23. For example, in this embodiment, as there are provided two rows of the pressure generation chambers 21, two rows of the piezoelectric actuators 40 are also provided.

Here, each of the piezoelectric actuators 40 is configured of a lower electrode film 43 provided on the vibration plate 23, a piezoelectric layer 44 separately provided to each of the pressure generation chambers 21, and an upper electrode film 45 provided on each of the piezoelectric layers 44. The piezoelectric layer 44 is formed by affixing or printing a green sheet which is made of a piezoelectric material. Further, the lower electrode film 43 is provided across the piezoelectric layers 44 arranged in parallel to serve as a common electrode of the plurality of piezoelectric actuators 40, and functions as part of the vibration plate 23. Needless to say, it is advisable that the lower electrode film 43 is provided to each of the piezoelectric layers 44. Furthermore, the upper electrode film 45 is provided separately to each of the piezoelectric layers 44 and serves as an individual electrode of each of the piezoelectric actuators 40. Although, in this embodiment, the lower electrode film 43 serves as a common electrode of the plurality of piezoelectric actuators 40 and the upper electrode film 45 serves as an individual electrode of each of the piezoelectric actuators 40, it is possible to reverse the services of the upper and lower electrode films considering the condition and arrangement of drive circuits or wiring.

The flow path forming substrate 22, the vibration plate 23, and the pressure generation chamber bottom plate 24, each of which is a layer constituting the actuator unit 20, are integrated through the following process without using any adhesive: a clayey ceramics material, i.e., a so-called green sheet is molded into with a predetermined thickness; the pressure generation chambers 21 and the like are perforated; then the sheets are laminated and baked, for example. Thereafter, the piezoelectric actuators 40 are formed on the vibration plate 23.

Meanwhile, the flow path unit 30 includes an ink-supply-opening forming substrate 31 that is attached to the pressure generation chamber bottom plate 24 of the actuator unit 20, a manifold forming substrate 33 in which a manifold 32 that serves as a common ink chamber of the plurality of pressure generation chambers 21 is formed, and a nozzle plate 35 in which the nozzle opening 34 is formed.

The ink-supply-opening forming substrate 31 is made of a thin zirconia plate with a thickness of 150 μm, and configured of a nozzle communication hole 36 that connects the nozzle opening 34 to the pressure generation chamber 21 and an ink supply opening 37 that connects, together with the supply communication hole 25, the manifold 32 and the pressure generation chamber 21. The nozzle communication hole 36 and the ink supply opening 37 are provided by perforating operation. In addition, an ink introduction opening 38 that communicates with each of the manifolds 32 and supplies ink from an external ink tank is provided in the ink-supply-opening forming substrate 31.

The manifold forming substrate 33 includes the manifold 32 that supplies ink delivered from the external ink tank (not shown) to the pressure generation chamber 21, and a nozzle communication hole 39 that communicates the pressure generation chamber 21 with the nozzle opening 34. The manifold 32 and the nozzle communication hole 39 are provided in a plate member suited to configuring an ink flow path, for example, a plate of stainless steel being 150 μm in thickness and having corrosion resistance.

The nozzle plate 35 is configured of the nozzle openings 34 that are formed through perforating operation in a thin plate which is made of stainless steel, for example. The nozzle openings 34 are arranged at the same arrangement pitch as the pressure generation chambers 21. For example, in this embodiment, since there are provided two rows of the pressure generation chambers 21 in the flow path forming substrate 22, two rows of the nozzle openings 34 are provided in the nozzle plate 35 as well. Further, the nozzle plate 35 is attached to the manifold forming substrate 33 on an opposite face to the side of the flow path forming substrate 22, and seals one face of the manifold 32.

The flow path unit 30 is formed by attaching the ink-supply-opening forming substrate 31, manifold forming substrate 33 and nozzle plate 35 to each other with an adhesive, a heat welding film or the like. Note that in this embodiment, although the manifold forming substrate 33 and the nozzle plate 35 are made of stainless steel, they may be made of ceramics and integrated through experiencing the same process as in the case of the actuator unit 20, for example.

The flow path unit 30 and the actuator unit 20 are attached and fixed to each other via an adhesive, a heat welding film or the like.

Figure 5:
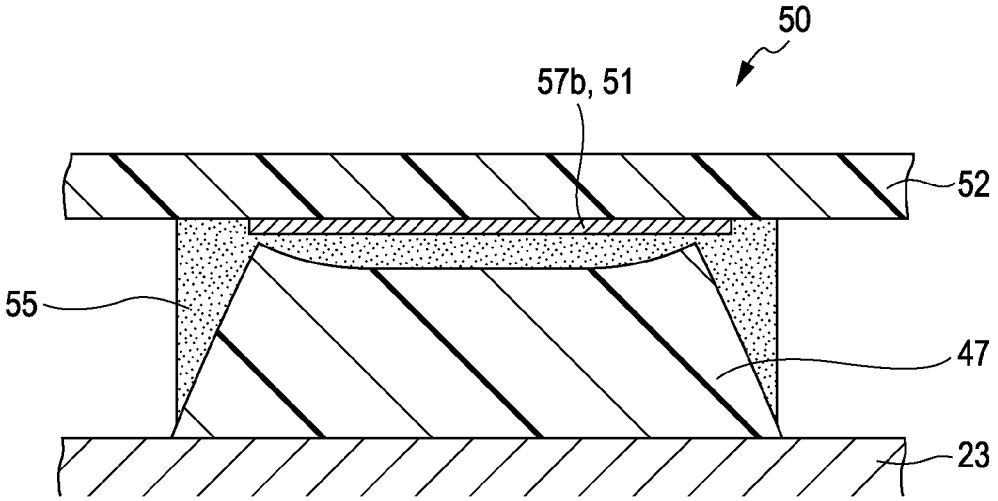
FIG. 5 is a cross-sectional view illustrating a recording head of the past technique according to the first embodiment.

As shown in FIGS. 3 through 5, an individual terminal portion 46 and a common terminal portion 47 as terminals portions conductively connecting to the piezoelectric actuator 40 are provided in an area facing a peripheral wall of the pressure generation chamber 21 at one end portion in the lengthwise direction of each of the piezoelectric actuators 40. The individual terminal portion 46 is provided to each of the piezoelectric actuators 40 and conductively connected to the upper electrode film 45 of the piezoelectric actuator 40. Meanwhile, the common terminal portion 47 is drawn out to each of end portion sides in the parallel arrangement direction of the piezoelectric actuators 40, and conductively connected to the lower electrode film 43. In the embodiment, there are provided two rows of the individual terminal portions 46 arranged in parallel to each other, between the rows of the piezoelectric actuators 40 arranged in parallel to each other; and the common terminal portions 47 are respectively provided at both end sides of the individual terminal portions 46 arranged in parallel to each other. Further, the common terminal portion 47 is provided to be common to the lower electrode films 43 of the two rows of the piezoelectric actuators 40. That is to say, the lower electrode films 43 of the two rows of the piezoelectric actuators 40 are continued at both the end portion sides in the parallel arrangement direction of the piezoelectric actuators 40, and the common terminal portions 47 are provided in these areas at which the lower electrode films 43 are continued.

It is to be noted that the common terminal portion 47 conductively connecting to the lower electrode film 43 has a wider area than the individual terminal portion 46 conductively connecting to the upper electrode film 45. The reason for this is as follows. In this embodiment, the lower electrode film 43 is provided as a common terminal common to the plurality of piezoelectric actuators 40. Therefore, when a large current is flown to the lower electrode film 43 as the common terminal portion so as to drive the plurality of piezoelectric actuators 40, it is necessary to reduce electric resistance of the connection portion so as to suppress a drop in the flowing current.

The individual terminal portion 46 and the common terminal portion 47 can be formed by, for example, screen printing with a metal material having a high conductivity such as silver (Ag) or the like.

A wiring layer 51 provided in the wiring substrate 50 is electrically connected to the individual terminal portion 46 and the common terminal portion 47 conductively connecting to each of the upper electrode films 45 and the lower electrode film 43 of the piezoelectric actuator 40. A drive signal is supplied to each of the piezoelectric actuators 40 from a drive circuit (not shown) via the wiring substrate 50. Although the drive circuit is not specifically illustrated in the drawings, it may be mounted on the wiring substrate 50, or may be mounted on a member other than the wiring substrate 50.

The wiring substrate 50 is a single substrate that is made of, for example, a flexible printing circuit (FPC), a tape carrier package (TCP) or the like. The wiring substrate 50 is provided over the two rows of the piezoelectric actuators 40. To be more specific, the wiring substrate 50 is a substrate in which the wiring layer 51 with a predetermined pattern is formed by tin plating on the surface of a base film 52 of polyimide or the like using a copper foil as a base, and areas aside from connection terminal portions connected to the individual terminal portions 46 and the common terminal portions 47 of the wiring layer 51 are covered with an insulation material 53 such as resist or the like.

In the wiring substrate 50, a through-hole 54 is provided in an area between the rows of the piezoelectric actuators 40 arranged in parallel to each other in which the rows are opposed to each other, and the wiring layer 51 is connected to the individual terminal portion 46 at an end portion thereof on the through-hole 54 side. Note that the through-hole 54 in the wiring substrate 50 is formed through the following process: the wiring layer 51 connected to one row of the piezoelectric actuators 40 and the wiring layer 51 connected to the other row of the piezoelectric actuators 40 are so formed as to be continued on the surface of the base film 52 in which the through-hole 54 has not been formed yet; then the wiring layer 51 conductively connecting to both the two rows of the piezoelectric actuators 40 is cut off. Further, in the embodiment, as shown in FIG. 2A, the through-hole 54 is formed only in an area of the wiring layer 51 connected to the individual terminal portions 46, and not formed at a side of the wiring layer 51 connected to the common terminal portion 47. Accordingly, the continuous wiring layer 51, which is not cut off by the through-hole 54, is connected to the common terminal portion 47 common to the lower electrode films 43 of the two rows of the piezoelectric actuators 40.

The wiring layer 51 includes an individual wiring layer 56 that is connected to the individual terminal portion 46 conductively connecting to the upper electrode film 45, and a common wiring layer 57 that is connected to the common terminal portion 47 conductively connecting to the lower electrode film 43. A tip portion of the individual wiring layer 56 is an individual connection terminal portion 56*a* that is connected to each of the individual terminal portions 46. Note that an area opposing to the common terminal portion 47 of the common wiring layer 57 is a common connection terminal portion 57*a* that is connected to the common terminal portion 47.

The common connection terminal portion 57*a* of the common wiring layer 57 and the common terminal portion 47 conductively connecting to the lower electrode film 43 have approximately the same area size. In addition, a plurality of slits 58 are arranged in parallel to each other on the common connection terminal portion 57*a*. The length of the slit 58 is longer than the width of the common terminal portion 47 (width in a direction perpendicular to the parallel arrangement direction of the piezoelectric actuators 40), and the slit 58 is provided penetrating through the common wiring layer 57 in the thickness direction thereof. Meanwhile, the width of the slit 58 is shorter than the width of the common terminal portion 47 (width in the parallel arrangement direction of the piezoelectric actuators 40), and a plurality of slits 58 are provided in the parallel arrangement direction of the individual termination portions 46 so that the plurality of slits 58 are opposed to a single common terminal portion 47.

The wiring layer 51 (the individual connection terminal portion 56*a* of the individual wiring layer 56, the common connection terminal portion 57*a* of the common wiring layer 57) of the wiring substrate 50 is electrically connected with the individual terminal portion 46 and common terminal portion 47 which are conductively connected to the piezoelectric actuator 40. Here, an anisotropic conductive material, for example, such as an anisotropic conductive film (ACF), an anisotropic conductive paste (ACP) or the like can be used for connecting the wiring layer 51 to the individual terminal portions 46 and common terminal portion 47. Note that, as an anisotropic material, known materials, for example, such as an epoxy-based resin, a resin ball plated with nickel and the like can be employed. In the embodiment, the wiring layer 51 of the wiring substrate 50 is mechanically and electrically connected to the individual terminal portion 46 and the common terminal portion 47 via an adhesive layer 55 formed of an anisotropic conductive adhesive. The adhesive layer 55 is provided over the plurality of individual terminal portions 46 arranged in parallel to each other and the common terminal portion 47; the wiring layer 51 is electrically connected with the individual terminal portions 46 and the common terminal portion 47 by the adhesive layer 55 provided between the wiring layer 51 and the individual terminal portions 46 and common terminal portion 47; and the flow path forming substrate 22 and the wiring substrate 50 are mechanically connected by the adhesive layer 55 provided between the neighboring individual terminal portions 46 as well as between the individual terminal portion 46 and the common terminal portion 47, and so on.

Here, as shown in FIG. 4, the common terminal portion 47 conductively connected to the lower electrode film 43 has an uneven surface in which is formed a protrusion portion 47*a* protruding to the circumference from the surface to which the wiring layer 51 is connected. The protruding portion 47*a* is formed when the common terminal portion 47 is formed by screen printing. To be more specific, in screen printing, a pattern of the individual terminal portions 46, the common terminal portion 47, and the like is formed by a screen plate; when the screen plate is removed after the printing, ink is pulled up by an opening edge portion of the pattern in the screen plate so that the protruding portion 47*a* is formed. In the case where this protruding portion 47*a* is present, if a common connection terminal portion 57*b* without the slits 58 is used in the common wiring layer 57, as shown in FIG. 5, conducive particles contained in the anisotropic material cannot be completely crushed in a flat area (central portion) surrounded by the protruding portions 47*a* of the common terminal portion 47. As a result, the area that connects the common terminal portion 47 to the common wiring layer 57 by the conductive particles is limited only to a portion near each of the protruding portions 47*a*, thereby reducing the connection area.

In contrast, in the embodiment, the common connection terminal portion 57*a* in which the slits 58 are provided is used in the common wiring layer 57. Accordingly, as shown in FIG. 4, the wiring substrate 50 deforms along the uneven surface of the common terminal portion 47 so that the common wiring layer 57 divided by the slits 58 is disposed along the surface of the common terminal portion 47. This makes it possible to substantially uniformize gaps between the plurality of common wiring layers 57 divided by the slits 58 and the surface of the common terminal portion 47, and completely crush the conductive particles between the common wiring layers 57 and the common terminal portion 47 so as to increase the connection area. As a result, an electric resistance of the connection portion of the common terminal portion 47 and the common wiring layer 57 (wiring layer 51) can be reduced. Accordingly, by reducing the electric resistance of the connection portion of the common terminal portion 47 and the common wiring layer 57 (wiring layer 51), it is possible to suppress a driving failure from occurring caused by a drop in the flowing current when the plurality of the piezoelectric actuators 40 are driven simultaneously, and it is also possible to suppress a breakdown, such as peeling off of the wiring layer 51 from the common terminal portion 47 and the like, from occurring caused by the heat generated at the connection portion.

In addition, in this embodiment, by providing the slits 58 in the common connection terminal portion 57*a* of the common wiring layer 57, the number of conductive particles to connect with the common terminal portion 47 can be increased. Therefore, because it is not required to increase the actual areas of the common connection terminal portion 57*a* of the common wiring layer 57, the common terminal portion 47 and the like, the ink jet recording head 10 can be miniaturized.

Note that, in the case where the common wiring layer 57 without the slits 58 (common connection terminal portion 57*b*) has been employed as shown in FIG. 5, the common terminal portion 47 and common wiring layer 57 have been conductively connected by approximately 30 to 100 conductive particles, and the electric resistance of the connection portion has been equal to or less than 0.1Ω. On the other hand, in the case where the common wiring layer 57 with the slits 58 (common connection terminal portion 57*a*) is employed as shown in FIG. 4, the common terminal portion 47 and the common wiring layer 57 are conductively connected by equal to or more than 100 conductive particles, and the electric resistance is equal to or less than 0.02Ω. Therefore, it has become possible to reduce the electric resistance.

As for the connection of the individual terminal portion 46 and the individual wiring layer 56, since the individual terminal portion 46 is conductively connected to the upper electrode film 45 serving as an individual electrode of each of the piezoelectric actuators 40, a large connection area is not needed. However, it is advisable that a plurality of slits are provided also in the individual connection terminal portion 56*a* so as to reduce electric resistance as in the case of the common connection terminal portion 57*a* of the common wiring layer 57 mentioned above.

In such configuration of the ink jet recording head 10, ink is introduced from an ink cartridge (reservoir unit) into the manifold 32 through the ink introduction opening 38, then the inside of a liquid flow path from the manifold 32 down to the nozzle opening 34 is filled with the ink. After this, a record signal from a drive circuit (not shown) is supplied to the piezoelectric actuator 40 via the wiring substrate 50; subsequently a voltage is applied to each of the piezoelectric actuators 40 corresponding to each of the pressure generation chambers 21 so as to cause the vibration plate 23 to deform in a flexural manner together with the piezoelectric actuator 40; as a result, the pressure in each of the pressure generation chambers 21 is raised so as to discharge an ink droplet through each of the nozzle openings 34.

Other Embodiments

Although one type of embodiment of the invention has been described so far, the basic configuration of the invention is not limited thereto. For example, in the aforementioned first embodiment, the lower electrode film 43 common to two rows of the piezoelectric actuators 40 is provided, and the common terminal portions 47 are provided at two locations so as to be connected with the wiring layer (common wiring layer 57) of the wiring substrate 50 at the two locations. However, the number of common terminal portions 47, the number of connections to the wiring layer 51 of the wiring substrate 50, and the like may be one (location), or may be equal to or more than three (locations). Needless to say, it is advisable that each independent lower electrode film 43 is provided to each of the two rows of the piezoelectric actuators 40.

Further, although in the aforementioned first embodiment, an actuator device employing the piezoelectric actuator 40 of a thick-film type is exemplified, the invention is not specifically limited thereto. For example, a thin-film type piezoelectric actuator in which a lower electrode, a piezoelectric layer, and an upper electrode are sequentially laminated by deposition and lithography methods can be used; in addition, a longitudinal-vibration type piezoelectric actuator in which piezoelectric materials and electrode forming materials are alternately laminated so as to expand and contract in the axial direction can be used.

Figure 6:
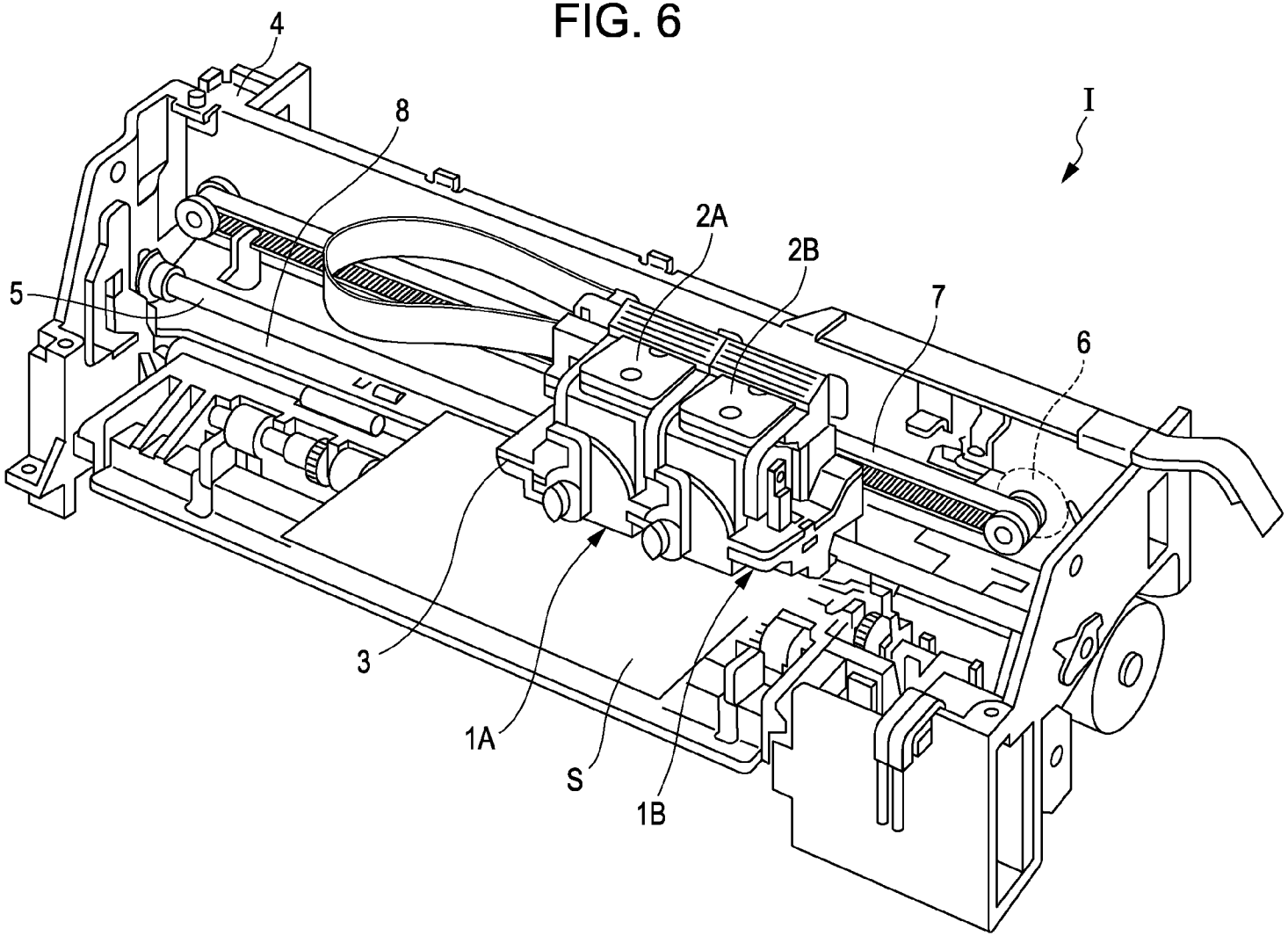
FIG. 6 is a schematic view illustrating an ink jet recording apparatus according to another aspect of the invention.

Furthermore, the ink jet recording head according to the above-mentioned embodiments configures part of a recording head unit having an ink flow path communicating with an ink cartridge or the like, and is mounted in an ink jet recording apparatus. FIG. 6 is a schematic view illustrating an example of the ink jet recording apparatus.

As illustrated in FIG. 6, cartridges 2A and 2B configuring an ink supply unit are detachably mounted in recording head units 1A and 1B including the ink jet recording head 10, and a carriage 3 that accommodates the recording head units 1A and 1B is provided to a carriage shaft 5 attached to an apparatus body 4 so as to be capable of freely moving in the shaft direction. The recording head units 1A and 1B respectively discharge a black ink composition and a color ink composition, for example.

When a drive force of a drive motor 6 is transmitted to the carriage 3 via a plurality of gears (not shown) and a timing belt 7, the carriage 3 accommodating the recording head units 1A and 1B is moved along the carriage shaft 5. Meanwhile, a platen 8 is disposed along the carriage shaft 5 in the apparatus body 4, and a recording sheet S, which is a recording medium such as paper or the like fed by a feed roller (not shown) or the like, is wound upon the platen and transported.

In the ink jet recording apparatus I mentioned above, although an example in which the ink jet recording heads 10 (recording head units 1A, 1B) are mounted in the carriage 3 and moved in the main scanning direction is described, the invention is not specifically limited thereto. For example, the invention can be applied to a so-called line type recording apparatus that performs printing only by moving the recording sheet S such as paper or the like in the sub scanning direction while the ink jet recording head 10 being fixed.

Further, in the aforementioned first embodiment, the ink jet recording head 10 as an example of a liquid ejecting head and the ink jet recording apparatus I as an example of a liquid ejecting apparatus are cited and explained. However, as the invention is intended to be widely applied to every kind of liquid ejecting heads and liquid ejecting apparatuses, the invention can be applied to liquid ejecting heads and liquid ejecting apparatuses that discharge liquid other than ink, of course. As other kinds of liquid ejecting heads, for example, various kinds of recording heads used in image recording apparatuses such as a printer and the like, coloring material ejecting heads used for manufacturing color filters of liquid crystal displays and the like, electrode material ejecting heads used for forming electrodes of organic EL displays, field emission displays (FEDs) and the like, bioorganic material ejecting heads for manufacturing biochips, and so on can be cited. It is to be note that the invention can be also applied to liquid ejecting apparatuses equipped with the liquid ejecting heads mentioned above.

What is claimed is:

1. A liquid ejecting head comprising:

a pressure generation chamber that communicates with a nozzle opening which ejects liquid;

a pressure generation unit that causes a change in pressure in the pressure generation chamber, the pressure generation unit having an individual electrode which is electrically connected to an individual terminal portion and a common electrode which is electrically connected to a common terminal portion that is common to a plurality of pressure generation units; and a wiring substrate that includes a first wiring layer which is connected to the individual terminal portion of the pressure generation unit and a second wiring layer which is connected to the common terminal portion of the pressure generation unit, the wiring substrate has flexibility, wherein the plurality of pressure generation units are formed in a state of being arranged in parallel to each other, the second wiring layer has slits at an area which is electrically connected to the common terminal portion of the pressure generation unit, and the second wiring layer of the wiring substrate and the common terminal portion of the pressure generation unit are connected via an anisotropic conductive material in the area.

2. The liquid ejecting head according to claim 1, wherein the pressure generation unit is provided on a flow path forming substrate in which the pressure generation chamber is formed, and the pressure generation unit is a piezoelectric element that includes an individual electrode, the common electrode, and a piezoelectric layer sandwiched between the individual electrode and the common electrode.

3. The liquid ejecting head according to claim 1, wherein when the common terminal portion of the common electrode is viewed from a plane perpendicular to a direction in which the slits extend, a contour of the common terminal portion of the common electrode is formed such that a periphery of a surface of the common terminal portion of the common electrode facing the wiring substrate is protruding higher toward the wiring substrate than a center of the common terminal portion.

4. A liquid ejecting apparatus comprising the liquid ejecting head according to claim 1.

5. A liquid ejecting apparatus comprising the liquid ejecting head according to claim 2.

6. A liquid ejecting apparatus comprising the liquid ejecting head according to claim 3.

* * * * *